US010787878B2

(12) United States Patent
Slack

(10) Patent No.: US 10,787,878 B2
(45) Date of Patent: Sep. 29, 2020

(54) APPARATUS FOR LAUNCHING WIPER PLUGS

(71) Applicant: NOETIC TECHNOLOGIES INC., Edmonton (CA)

(72) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 16/089,200

(22) PCT Filed: Mar. 31, 2017

(86) PCT No.: PCT/CA2017/000072
§ 371 (c)(1),
(2) Date: Sep. 27, 2018

(87) PCT Pub. No.: WO2017/173522
PCT Pub. Date: Oct. 12, 2017

(65) Prior Publication Data

US 2019/0120009 A1 Apr. 25, 2019

Related U.S. Application Data

(60) Provisional application No. 62/319,262, filed on Apr. 6, 2016.

(51) Int. Cl.
*E21B 23/04* (2006.01)
*E21B 33/068* (2006.01)
(Continued)

(52) U.S. Cl.
CPC ..... *E21B 33/068* (2013.01); *E21B 33/14* (2013.01); *E21B 33/16* (2013.01)

(58) Field of Classification Search
None
See application file for complete search history.

(56) References Cited

U.S. PATENT DOCUMENTS 3,948,322 A 4/1976 Baker
4,893,678 A * 1/1990 Stokley ..... E21B 33/127 166/238
(Continued)

FOREIGN PATENT DOCUMENTS

CA 2867207 A1 12/2014
EP 2881538 A2 6/2015

OTHER PUBLICATIONS

International Preliminary Report on Patentability (Chapter II) re PCT/CA2017/000072 by the IPEA/CA dated Jun. 21, 2018.
(Continued)

*Primary Examiner* — Matthew R Buck
*Assistant Examiner* — Douglas S Wood
(74) *Attorney, Agent, or Firm* — Donald V. Tomkins

(57) ABSTRACT

A tool for launching wiper plugs into a casing string in a gas or oil well during cementing operations employs a collet-like mechanism carrying radially-movable jaws arranged to retain a plug in a fluid flow path when the tool is in a closed position, and to release the plug into the fluid flow path when the tool is in an open position. Selection of the desired operational position of the plug launcher (i.e., open or closed) is effected by actuation of an axially-movable sliding sleeve. Alternative means for actuating the sliding sleeve include rotary actuation about the tool's longitudinal axis, rotary actuation about a radial axis generally normal to the longitudinal axis, rotary actuation about a generally tangent axis, and pneumatic or hydraulic actuation. The tool may be adapted to carry multiple wiper plugs for sequential launching into a casing string.

24 Claims, 6 Drawing Sheets

(51) Int. Cl.

| | |
|---|---|
| ***E21B 33/16*** | (2006.01) |
| ***E21B 33/14*** | (2006.01) |
| *E21B 33/10* | (2006.01) |
| *E21B 47/12* | (2012.01) |

(56) References Cited

U.S. PATENT DOCUMENTS

| | | | | |
|---|---|---|---|---|
| 5,413,172 | A | 5/1995 | Laurel | |
| 5,722,491 | A | 3/1998 | Sullaway et al. | |
| 8,256,515 | B2 | 9/2012 | Barbee | |
| 2013/0112435 | A1 | 5/2013 | Fleming et al. | |
| 2015/0136395 | A1 | 5/2015 | Turley et al. | |
| 2015/0136396 | A1* | 5/2015 | Turley ..... | E21B 23/08 166/285 |

OTHER PUBLICATIONS

Supplementary Partial European Search Report (European Patent Office) dated Dec. 10, 2019 re EP Patent Application No. 17778495 (EP regional phase of PCT/CA2017/000072).

* cited by examiner

APPARATUS FOR LAUNCHING WIPER PLUGS

FIELD

The present disclosure relates in general to apparatus for launching wiper plugs, wiper darts, or other articles during cementing operations for completion of oil and gas wells.

BACKGROUND

It is well known to form a well, such as an oil or gas well, by using a drilling rig to rotate a bit attached to the end of a string of drill pipe such that the bit advances through subterranean soil formations to form a borehole of desired length and orientation. It is common practice to run a string of casing pipe into the borehole, leaving an annulus between the casing string and the borehole, and then to introduce a cement slurry into at least a portion of the borehole annulus. This is commonly called a cementing operation.

Cementing operations can be carried out in a number of different ways, but one common procedure involves introducing a first (or "lower") wiper plug into the upper end of the casing string, and then pumping a selected quantity of cement slurry into the the casing, displacing the lower wiper plug downward within the casing. A second (or "upper") wiper plug is then inserted into the upper end of the casing string, after which a suitable fluid (for example, a drilling fluid) is pumped into the casing, displacing the upper wiper plug, the wet cement slurry, and the lower wiper plug downward within the casing string, such that the slurry is forced out the lower end of the casing and upward into the wellbore annulus. Due to fluid density differences, the cement slurry flowing upward into the wellbore annulus will displace any drilling fluid or other fluid present in the annulus. This process is continued until the cement slurry has reached a desired level in the annulus.

The upper and lower wiper plugs provide positive separation between the cement slurry and the wellbore fluids. The lower wiper plug is typically configured such that its downward movement within the casing string will be to be stopped by a "cement shoe" provided at the lower end of the casing. The lower wiper plug has a center bore that is initially closed off by a "burst disk" that will fail (i.e., burst) at a selected differential pressure, thus allowing the cement slurry to flow through the lower wiper plug and out the bottom of the casing and up the wellbore annulus. The upper wiper plug similarly has a center bore that is initially closed by a burst disk, but with a burst pressure higher than the burst pressure of the lower wiper plug.

A cementing head (of which there are numerous known types) is used to connect the upper end of the casing string with flow lines through which cement slurry and other fluids can be pumped into the casing. As well, the cementing head typically provides a structural connection between the drilling rig and the casing string to transfer vertical hoisting loads and torsional loads into the casing string as necessary during so-called "hoist, reciprocate, and rotate" manipulations of the casing string, which are used to promote optimally effective displacement of fluids by the cement slurry, and to promote optimally uniform distribution of the slurry within the cemented region of the wellbore annulus.

The cementing head also must accommodate the introduction of the wiper plugs into the casing bore (or "dropping a plug", as this procedure is commonly called). In accordance with one simple method, this can be achieved by disconnecting the cementing head from the upper end of the casing string and manually inserting the wiper plug. However, this simple method is feasible only where the cementing procedure being used will permit temporary stoppage of fluid flow such that the pressure at the cementing head will not exceed atmospheric pressure when the plug is dropped. Moreover, any advantages arising from the simplicity of this method of dropping a plug will typically be offset by the additional time and labor required to disconnect and reconnect the cementing head, plus the added risks of environmental damage and injuries to workers in the event of accidental and uncontained fluid spillage.

To avoid such disadvantages and risks, it is common for "plug launchers" to be incorporated into cementing heads. Plug launchers facilitate the introduction of wiper plugs and other accessory articles familiar to persons skilled in the art (e.g., balls or "darts") into the flow path of fluids within the casing bore without needing to disconnect the cementing head or associated flow lines. As used in this patent specification, the term "plug" is to be understood as a general term encompassing articles and devices (such as but not limited to wiper plugs, wiper darts, and balls) that may be introduced into a fluid flow path within a tubing string (such as but not limited to a casing bore).

A plug launcher will typically contain the plug within the pressured envelope of the cementing head assembly, with means being provided for retaining the plug (such as by way of suitable latching means) when the plug launcher is in a closed position, and for releasing (i.e., "launching" or "dropping") the plug when the plug launcher is in an open position. When the plug launcher is in the closed position, flowing fluid can by-pass the plug and enter the casing string bore as required by the cementing operation in preparation for dropping a plug. After the plug launcher has been moved to the open position, the continued pumping of fluid into the casing will force the plug downward within the casing bore.

Examples of prior art plug launchers are disclosed in U.S. Pat. No. 4,671,353 (Darning); U.S. Pat. No. 6,575,238 (Yokley); U.S. Pat. No. 7,066,249 (Simson); and U.S. Pat. No. 8,256,515 (Barbee).

It is known for plug launchers to provide for a flag or release indicator disposed downstream of the location where a plug was initially retained (i.e., when the plug launcher was in the closed position), to facilitate the determination or confirmation that the plug was in fact introduced into the fluid flow path after the plug launcher was moved to the open position. The desirability of such flags or release indicators has arisen at least in part from inadequate reliability of known plug launchers in which the means for selectively retaining or releasing a plug typically uses some form of gate valve or ball valve components. As well, such prior art plug-launching devices tend to have bulky valve actuation assemblies protruding radially outward from the plug launcher body, thus creating additional hazards under rotation.

BRIEF SUMMARY

The present disclosure teaches a plug launching tool employing a collet-like mechanism that carries one or more radially-movable jaws arranged to retain a plug in a fluid flow path when the plug launcher is in a closed position, and to release the plug into the fluid flow path when the plug launcher is in an open position. Selection of the desired operational position of the plug launcher (i.e., open or closed) is effected by actuation of an axially-movable sliding sleeve.

In one embodiment in accordance with the present disclosure, the plug launcher comprises:

a generally axisymmetric housing having a profiled interior bore;

a sliding sleeve assembly sealingly and coaxially disposed within the housing bore and axially movable therein;

actuation means, for axially moving the sliding sleeve within the housing, between a closed position and an open position;

a plug receiver bore carried by the housing or by the sliding sleeve assembly, wherein:

the plug receiver bore is in upstream fluid communication with the housing bore;

the plug receiver bore includes a plug retainer interval for receiving a selected plug; and the plug receiver bore is sized to allow passage of the selected plug downstream of the plug retainer interval;

a collet assembly coaxially disposed within the housing bore and carried by either the sliding sleeve or the housing, wherein:

the collet assembly includes a collet body having a generally cylindrical bore to accommodate passage of the plug; and the collet body carries at least one but preferably three or more jaw segments (alternatively referred to as "collet jaws"), with the jaw segments being linked to the collet body so as to be radially (and resiliently) movable between a radially-inward closed position and a radially-outward open position, while at the same time being substantially constrained against other relative translational or rotational movement, wherein:

the collet jaws are configured to project radially inward from the collet body and, when in the closed position, to at least partially occlude the receiver bore, and thus to provide means for gripping or retaining a plug if present; or the collet jaws are provided with upstream-facing land surfaces projecting radially inward so as to collectively provide a land for the plug and thus to retain it in the receiver bore, but wherein the plug will be released when the jaws are moved into the radially-outward open position; and a linkage acting between the collet jaws and the housing (when the collet is carried by the sliding sleeve as in the preferred embodiment), or between the collet jaws and the sliding sleeve (when the collet is carried by the housing), so as to link axial movement of the sliding sleeve to radial movement of the collet jaws, thus tending to dispose the collet jaws in their closed and open positions when the sleeve is placed in its closed and open positions, respectively.

In another embodiment in accordance with the present disclosure, the plug launcher facilitates annular by-pass flow when in the closed position, and also facilitates selective closing-off of the annular by-pass flow when in the open position. This particular embodiment of the plug launcher comprises:

an elongate and generally axisymmetric outer housing assembly having a profiled bore, and being configured for integration into a cementing head system;

an elongate and generally cylindrical receiver cage having a main body with upper and lower ends and defining a plug receiver bore, wherein:

the receiver cage is coaxially disposed within the outer housing;

the housing bore is profiled to be close-fitting with and to rigidly support the cage at the upper end and/or at the lower end thereof, while providing an annular region between the housing and cage in the main body interval;

the housing bore extends throughout the interior of the assembled outer housing and receiver cage, and is sized to be close-fitting with a selected plug and to allow downstream passage of the plug under flow conditions; and the main body of the receiver cage has upper and lower sets of cage ports extending through the wall of the cage's main body, leaving an unported interval between the upper and lower receiver cage ports, and defining a retained plug interval in a mid-section of the cage's main body, with the length of the retained plug interval being selected to be at least approximately equal to the intended plug length;

a sliding sleeve assembly coaxially disposed in an annular region at an axial position generally corresponding to the upper ports in the receiver cage, wherein:

the sliding sleeve comprises a piston slidably and sealingly disposed within the outer housing bore;

the piston and the outer housing bore are configured to accommodate an axial stroke as necessary for movement of the piston between closed and open positions;

the inside bore of the sliding sleeve assembly is arranged to interact with the upper cage ports such that when the sleeve is in the closed position, the cage ports will be uncovered and thus will allow fluid flow into the annulus through the upper cage ports;

additional annular clearances are provided to allow annular flow downstream to the lower ports of the receiver cage, so as to provide a by-pass flow path around the plug receiver interval; and movement of the sleeve to the open position will fully or partially block off the upper ports so as to prevent or restrict fluid flow into the annulus, and thereby to divert at least part of the fluid flow through the receiver bore interval; and a collet assembly comprising a generally cylindrical collet body carried by the sliding sleeve, and carrying a plurality of collet jaws linked to the collet body by elastically resilient, axially-extending arms that preferably bias the collet jaws toward a radially-open position, wherein:

the collet assembly is configured to axially position the collet jaws in receiver cage lower ports that thus also act as windows allowing the jaws to extend radially through the receiver cage wall, with the arms being operatively engageable with the profiled housing bore through a first cam interface to force the jaws into the closed position when the sleeve is moved to the closed position; and the collet jaws are operatively engageable with the receiver cage through a second cam interface provided by contact between the collet jaws and cage port wall surfaces in which they move, tending to positively force the jaws into the open position (in addition to the biasing force provided by the flexible arms) when the sleeve is moved to the open position.

Thus arranged with the sliding sleeve in the closed position and having a plug installed in the retained plug interval, the plug launcher bore is effectively blocked off. However, the ports provided in the receiver cage above and below the retained plug interval are configured and arranged to open into the annular region, thus providing fluid communication by-passing the blocked-off plug launcher bore and facilitating fluid flow into the wellbore as may be required prior to launching the plug.

It is desirable for a plug launcher to enable the launching of plugs during fluid flow conditions. However, in prior art devices that provide annular by-pass flow closure (such as U.S. Pat. No. 8,256,515), the fully-open (i.e., plug release) position of the valve can only be achieved concurrently with annular by-pass flow closure. When attempting to launch a plug under flowing conditions, this operational limitation tends to result in excess differential pressure across the plug prior to the valve being moved into the fully-open position, with the attendant risk of premature rupture of the plug bore burst disk and resultant damage to the plug body, thereby affecting the plug's ability to wipe effectively, or causing it to jam in the plug launcher.

Plug launcher embodiments in accordance with the present disclosure mitigate or eliminate these limitations and risks, because when the sliding sleeve is displaced toward the closed position, the sleeve will be axially displaced within the annulus so as to incrementally close or to largely block the upper cage ports, thus preventing by-pass flow only after the jaw lands are retracted. This provides for flow path overlap when the sleeve is moving between its closed and open positions, allowing open-bore flow in conjunction with plug displacement before closing annular flow, thus minimizing the risk of excess differential pressure load across the plug. This arrangement thus facilitates reliable plug launching under a range of flow conditions without the operational limitations of prior art devices that either require flow stoppage or limited flow in order to protect the plug where by-pass flow restriction is provided, or require relatively high flow rates in order to reliably displace the plug where little or no by-pass flow restriction is provided.

The plug launcher may include a piston (as described above) to enable mechanical and/or fluid actuation of the sliding sleeve between closed and open positions. The piston is sealingly engageable with the bore of the outer housing along a defined interval thereof, to provide containment of wellbore fluids and thus allow through-wall openings to be placed in the housing within this interval. These openings may serve as piston actuation slots for mechanical actuation of the sleeve (with the slot length corresponding to at least the length of the sliding sleeve's stroke), or as piston actuation ports to facilitate fluid-powered actuation. The slots provide access through the housing wall for direct application of axial force to move the piston and perhaps to retain it in position.

Alternative means and methods for actuating the sliding sleeve include, but are not limited to: (1) rotary actuation about the housing axis; (2) rotary actuation about a radial axis generally normal to the housing surface; and (3) rotary actuation about a generally tangent axis. More specifically:

(1) Rotary actuation about the housing axis may be provided by means of a rotary drive sleeve coaxially mounted to and close-fitting with the housing exterior, allowing rotation about the housing axis but reacting against axial translation along the housing. The rotary drive sleeve threadingly engages a stroking drive sleeve that is close-fitting with and slidably mounted to the housing, but it is connected (through the housing slots) to the sliding sleeve piston so as to prevent rotation about the housing axis, and thus will stroke the sliding sleeve upon rotation of the rotary drive sleeve.

(2) Rotary actuation about a radial axis may be provided by means of a drive gear rotating on a radially-oriented axle externally mounted to the sliding sleeve, with the drive gear being arranged to mesh with ring gear teeth provided on the rotary drive sleeve.

(3) Similarly, rotary actuation about a tangent axis may be provided by means of a worm gear tangentially mounted to the housing surface and engaging gear teeth provided on the rotary drive sleeve.

Additionally, remote actuation of the piston under rotation may be facilitated by providing clutch or braking devices reacting between the rotary drive sleeve and the drilling rig, such as described in U.S. Pat. No. 7,909,120 (Slack et al.)—see, for example, FIG. 22.

In embodiments where the piston is carried by the housing, fluid actuation of the sliding sleeve may be provided by means of a double-acting hydraulic or pneumatic actuator, with the housing being configured to act as the cylinder body, and having external ports for entry of the pressurized actuating fluid, with either rigid or swiveling fluid line connections to the fluid entry ports as appropriate for particular operational requirements.

Accordingly, in a first aspect the present disclosure teaches a plug-launching tool comprising: a generally axisymmetric housing having a housing bore; a sliding sleeve sealingly and coaxially movable within the housing bore; and actuation means, for axially moving the sliding sleeve between a closed position and an open position. A plug receiver bore is carried by either the housing or the sliding sleeve, with the plug receiver bore being in upstream fluid communication with the housing bore. The plug receiver bore includes a plug retainer interval configured for receiving a selected plug and to allow passage of the plug downstream of the plug retainer interval.

The plug-launching tool in accordance with this first aspect of the disclosure also includes a collet assembly coaxially disposed within the housing bore and carried by either the sliding sleeve or the housing. The collet assembly includes a collet body having a generally cylindrical bore configured to accommodate passage of the plug. The collet body carries one or more collet jaws linked to the collet body so as to be movable between a radially-inward closed position and a radially-outward open position, wherein:

the collet jaws, in the closed position, at least partially occlude the receiver bore, so as to grip or retain the plug; or the one or more collet jaws are provided with upstream-facing land surfaces projecting radially inward so as to retain the plug when the collet jaws are in the closed position.

The tool also includes linkage means, for linking axial movement of the sliding sleeve to radial movement of the collet jaws, such that the collet jaws will be urged toward their closed and open positions when the sliding sleeve is moved toward its closed and open positions, respectively.

In accordance with a second aspect, the present disclosure teaches a plug-launching tool comprising a generally axisymmetric housing having a housing bore, and a generally cylindrical receiver cage having a main body with upper and lower ends and defining a plug receiver bore. The receiver cage is coaxially disposed within the housing. The housing bore is configured to support the receiver cage at the upper end and/or at the lower end thereof, and defines a housing bore annulus between the housing and the receiver cage's main body. The housing bore extends through housing and the receiver cage, and is configured to allow downstream passage of a selected plug. Upper and lower sets of receiver cage ports extend through a wall of the receiver cage's main body, defining an unported receiver cage interval between the upper receiver cage ports and the lower receiver cage ports, and defining a retained plug interval in a middle region of the receiver cage's main body, with the length of the retained plug interval being at least approximately equal to the length of the selected plug.

The plug-launching tool in accordance with this second aspect of the disclosure also includes a sliding sleeve coaxially and slidably disposed within the housing bore annulus in a region generally corresponding to the upper ports in the receiver cage, wherein the sliding sleeve is movable between:

- a closed position in which the upper receiver cage ports are uncovered so as to allow fluid flow into the housing bore annulus through the upper receiver cage ports; and
- an open position in which the upper receiver cage ports are at least partially blocked so as to restrict fluid flow into the housing bore annulus, such that at least part of the fluid flow will be diverted through the receiver bore interval;

Also provided is a fluid flow path by-passing the plug receiver interval, to allow downstream fluid flow within the housing annulus to the lower receiver cage ports.

The tool further includes a collet assembly comprising a plurality of collet jaws linked to the sliding sleeve by collet arms extending axially downward from the sliding sleeve. The collet assembly is configured to axially position each collet jaw in an associated lower receiver cage lower port such that the collet jaws will extend radially inward into the plug receiver bore. The collet arms are engageable with the housing bore through a first cam interface to urge the collet jaws toward their closed position when the sliding sleeve is moved toward its closed position. The collet jaws are engageable with the receiver cage through a second cam interface between the jaw segments and surfaces of the receiver cage ports in which they move, so as to urge the collet jaws toward the open position when the sliding sleeve is moved toward its open position.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Plug-Launching Tool—First Embodiment

Figure 1:
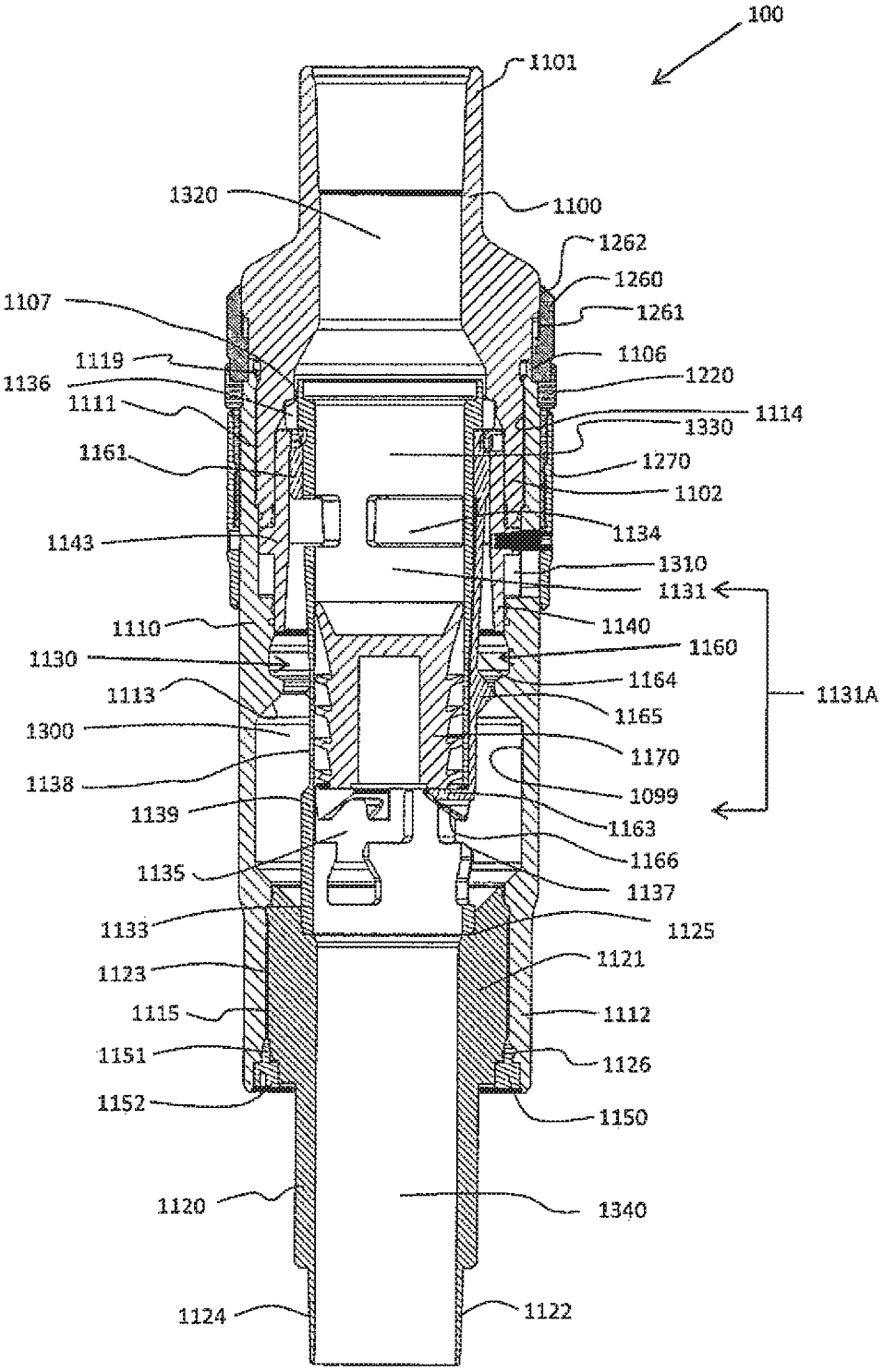
FIG. 1 is a longitudinal cross-section though one embodiment of a plug-launching tool in accordance with the present disclosure, shown in its retracted position.
Figure 1A:
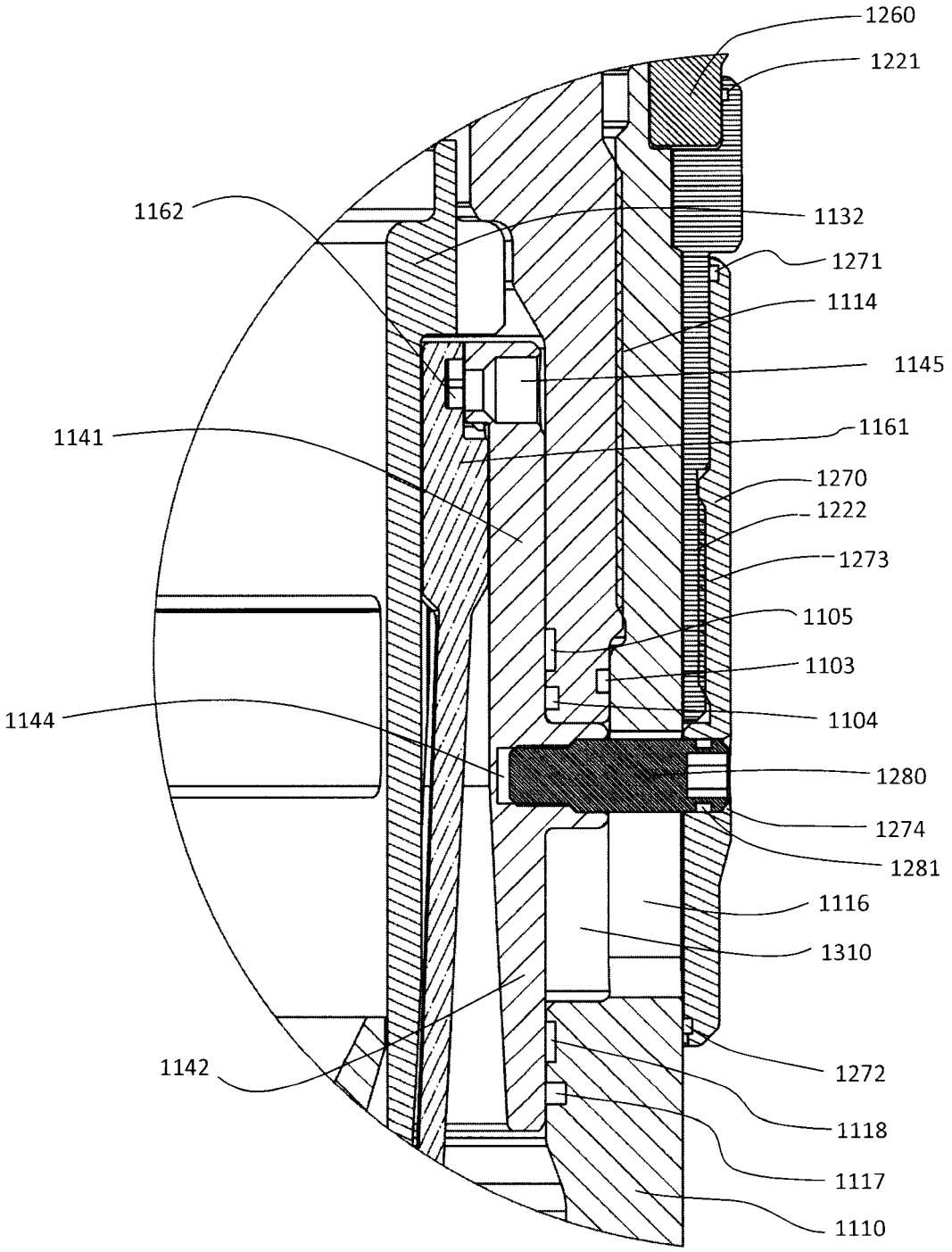
FIG. 1A is an enlarged cross-sectional detail view of the plug-launching tool in FIG. 1.
Figure 2:
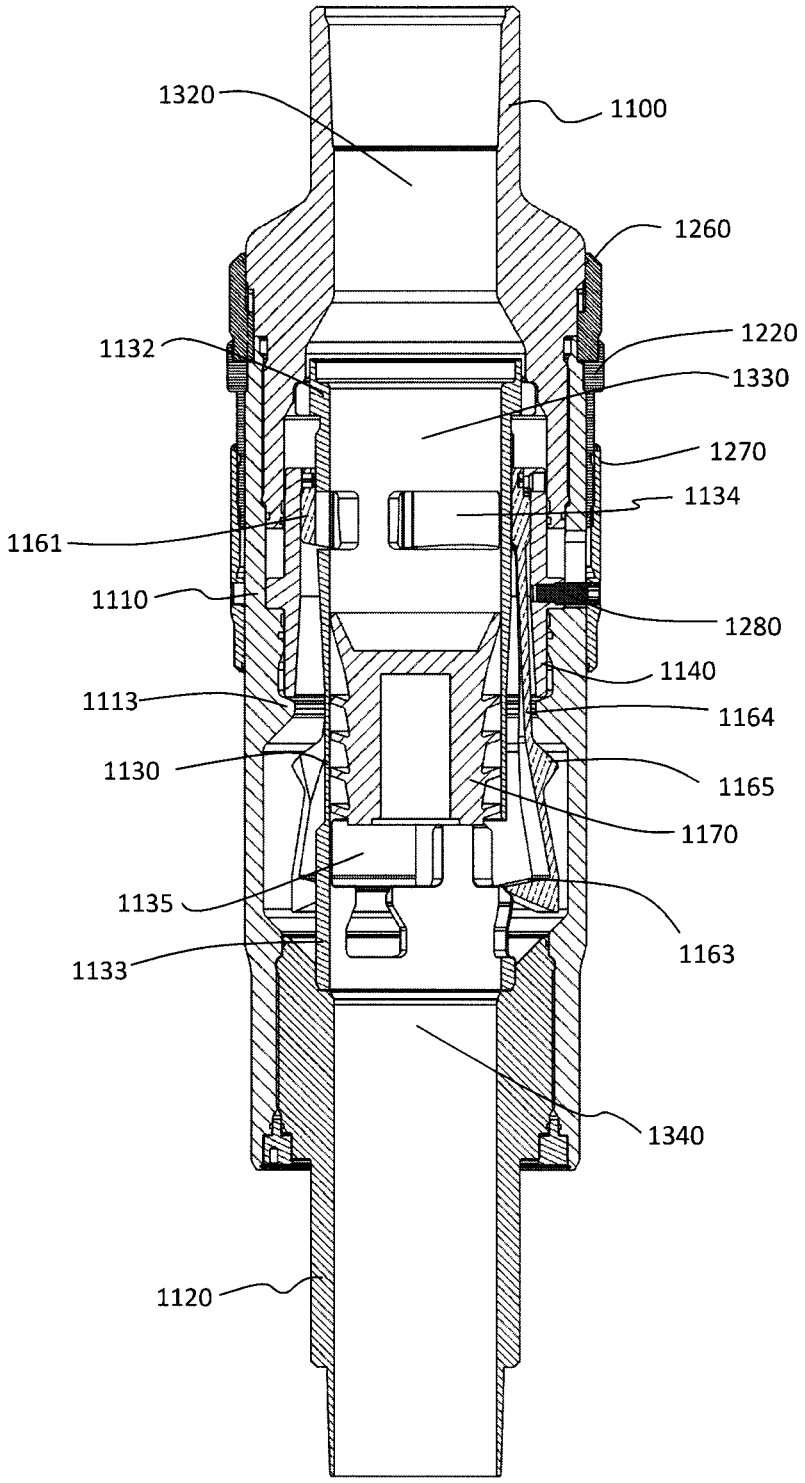
FIG. 2 is a longitudinal cross-section through the plug-launching tool in FIG. 1, shown in its extended position.

FIGS. 1, 1A, and 2 illustrate a first embodiment 100 of a plug-launching tool in accordance with the present disclosure, comprising: a generally axisymmetric housing assembly; a sliding sleeve assembly; means for axially moving the sliding sleeve; a collet assembly with collet jaws; and a linkage between the collet assembly, the housing assembly, and the sliding sleeve assembly.

In the embodiment shown in FIG. 1 and FIG. 1A, the housing assembly is provided in the form of an elongate and generally axisymmetric housing configured for integration into a cementing head assembly. More specifically, the housing assembly includes:

- a generally cylindrical outer housing 1110 having upper and lower ends 1111 and 1112, and further having an internal bore 1099 defining a housing ramp 1113, an upper connection thread 1114, a lower connection thread 1115, translation slot through-wall openings 1116 (alternatively referred to herein as piston actuation slots), a seal groove 1117 and a wiper groove 1118, and a spline segment 1119;
- a generally cylindrical receiver cage 1130 coaxially disposed within internal bore 1099 of outer housing 1110;
- a generally cylindrical and stepped top cap 1100 having upper and lower ends 1101 and 1102;
- an external seal groove 1103, an internal seal groove 1104, an internal wiper groove 1105, and top cap splines 1106; and
- a generally cylindrical stepped bottom cap 1120 having upper and lower ends 1121 and 1122, an external thread 1123, a casing thread 1124 on lower end 1122, a stepped face 1125, and a seal groove 1126.

Receiver cage 1130 comprises a main body 1139 having upper and lower ends 1132 and 1133 and defining a plug receiver bore 1131, with upper and lower sets of cage ports 1134 and 1135 to allow fluid flow through the side wall 1138 of receiver cage 1130. An upper spline pattern 1136 on upper end 1132 of receiver cage 1130 engages a mating spline pattern 1107 on top cap 1100 to react against rotation of cage 1130 relative to housing 1110 and bottom cam face 1137.

The housing assembly is configured to be close-fitting with and to rigidly support cage 1130 at its upper and lower ends 1132 and 1133, including top cap 1100, bottom cap 1120, and outer housing 1110. More specifically, lower end 1133 of cage 1130 is supported by stepped face 1125, with rotational location timing being provided by engagement of cage splines 1136 and top cap splines 1106. Outer housing 1110 has an internal profile defining an annular region 1300 between outer housing 1110 and cage 1130, to thereby allow downstream passage under flow.

Lower end 1102 of top cap 1100 has external threads that are engageable with internal threads on upper end 1111 of housing 1110, for transferring hoist loads from top cap 1100 to housing 1110. Upper end 1101 of top cap 1100 is adapted for securing the assembly (by any suitable means) to components rigged into a top-drive drilling rig.

Seal grooves 1103 and 1104 are provided on the outer and inner diameters, respectively, of top cap 1100 at lower end 1102 thereof. A suitable seal element installed in external seal groove 1103 seals against the upper section of housing 1110 above piston actuation slots 1116 to prevent contaminants from entering annular space 1310 from above. A wiper groove 1105 is provided on the inner diameter of top cap 1100, just above inner seal groove 1104, with a suitable wiper being installed in the groove along the articulating surface between a generally cylindrical piston 1140 and top cap 1100. Seal groove 1117 and wiper grooves 1118 contain suitable seal and wiper elements to prevent the exit of contaminants or fluid from the fluid bore section of tool 100.

Upper end 1121 of the bottom cap 1120 has external threads 1123 that engage internal threads 1115 on lower section 1112 of housing 1110. Upper end 1121 of bottom cap 1120 is configured for mating engagement with lower end 1133 of receiver cage 1130. Lower end 1122 of bottom cap 1120 is threadingly engageable with a casing string. As shown in FIG. 1, a bottom closure ring 1150 having an annular upper section 1151 and an annular lower section 1152 is provided to close off the annular gap between housing 1110 and bottom cap 1120 and to transfer torque from housing 1110 to bottom cap 1120. Seal grooves 1126 are provided in a lower region of the outer surface of bottom cap 1120 for sealing against upper section 1151 of bottom closure ring 1150, to prevent housing contamination from the lower end of tool 100.

The sliding sleeve assembly includes a sliding sleeve 1161 coaxially disposed within an annular region 1300 at an axial position generally corresponding to the position of upper receiver cage ports 1134. In the illustrated embodiment, the sliding sleeve assembly includes a generally cylindrical piston 1140 that is axially movable within a cylindrical interval of the bore of housing 1110, with the length of this cylindrical bore interval being sized to accommodate the axial stroke of piston 1140 and sliding sleeve 1161 of a collet assembly 1160 (described below). Piston 1140 has an upper end 1141, a lower end 1142, and a radially-extending, stepped middle section 1143 with threaded lug holes 1144 and a top lug hole 1145. A seal element installed in inner seal groove 1104 seals against the outer diameter of upper section 1141 of piston 1140.

Sliding sleeve 1161 is configured to interact with upper cage ports 1134 such that when sleeve 1161 is in the closed position (as seen in FIG. 1), cage ports 1134 are open, thus allowing flow into the annulus through upper cage ports 1134 and allowing annular flow downstream to lower receiver ports 1135. This annular flow follows a by-pass flow path around receiver plug interval 1131. When sliding sleeve 1161 is in the open position (as seen in FIG. 2), sleeve 1161 fully or partially blocks upper ports 1134, thereby preventing or restricting fluid flow into the annulus and forcing the fluid to flow through the receiver bore interval.

Collet assembly 1160 in the illustrated embodiment comprises collet jaws 1163 linked to sliding sleeve 1161 by axially-extending arms 1164 that preferably are elastically resilient or otherwise configured to bias collet jaws 1163 toward the radially-open position. In the illustrated embodiment, sliding sleeve 1161 is generally cylindrical and has a top lug hole 1162, with each collet arm 1164 having a collet ramp 1165. This arrangement is configured to axially position jaws 1163 in receiver cage ports 1135, allowing them to extend radially through the receiver cage wall, so as to partially protrude into the receiver bore on the inner diameter of cage 1130, and thus to provide a land for the selected wiper plug 1170 and to retain it in the receiver bore.

Collet ramps 1165 on collet arms 1164 are engageable with the profiled bore of housing 1110 on housing ramp 1113. These surfaces act as a first cam interface forcing collet jaws 1163 into the closed position when sliding sleeve 1161 is moved to its closed position. Cam surface 1137 on cage 1130 and collet jaw bottom ramps 1166 on collet jaws 1163 define a second cam interface as sleeve 1161 is moved to the open position, with collet arms 1164 tending to force jaws 1163 radially outward and thus removing the protrusion into the receiver bore. As such, the land for the selected plug is effectively removed from the receiver bore and no longer provides means for retaining plug 1170.

Sliding sleeve 1161 is provided with axial movement means, for moving sleeve 1161 axially within and relative to housing 1110 for purposes of actuating the plug-launching tool 100 between the closed and open positions. As best seen in FIG. 1A, piston 1140 sealingly engages seal elements in grooves 1117 and 1118 on housing 1110 and seal elements in grooves 1104 and 1105 on top cap 1100, thus providing containment of wellbore fluids. This allows through-wall piston actuation slots 1116 to be placed in this interval, and creates an annular section 1310 between the exterior of housing 1110 and piston 1140. Piston actuation slots 1116 provide access through the wall of housing 1110 to enable direct application of axial force to move or hold piston 1140 in a desired axial position relative to housing 1110.

Piston 1140 may be actuated by a variety of different means, and embodiments in accordance with the present disclosure are not limited or restricted to the use of any particular actuation means, whether disclosed herein or not. By way of non-limiting example, the piston actuation means may comprise a mechanical gear reduction assembly that mounts directly onto the outside of plug-launching tool 100.

Figure 3:
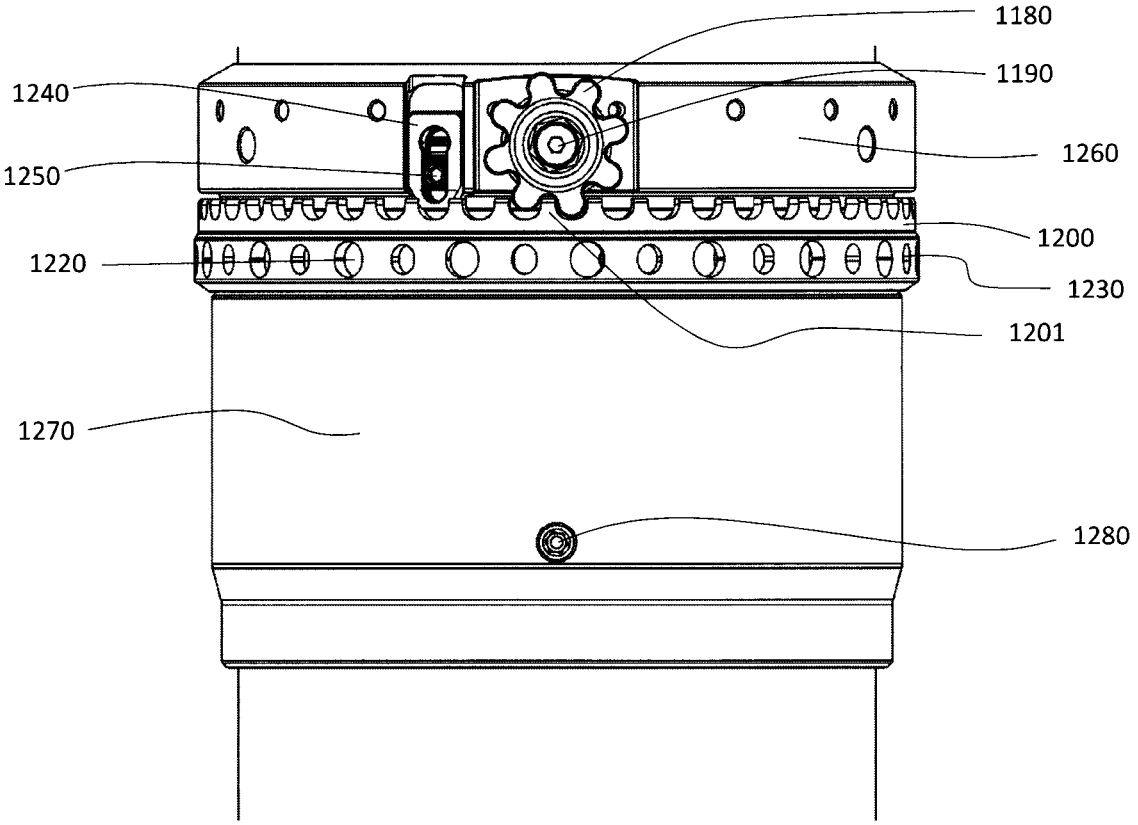
FIG. 3 is a side view of an actuation gear mechanism that may be used to move the sliding sleeve from its closed to open positions in the plug-launching tool in FIG. 1.

FIGS. 1, 1A, and 3 illustrate a gear actuation assembly adapted to convert rotation of a pinion gear 1180 along an axis radially perpendicular to the longitudinal axis of housing 1110 into an axial stroke of sleeve 1161, thereby moving collet jaws 1163 along the collet's two cam interfaces between their closed and open positions. The gear actuation assembly comprises a pinion-type drive gear 1180, a pinion gear lug 1190, a driven ring gear 1200 with profiled teeth 1201 coaxially mounted on the outer radial face of a generally cylindrical rotary drive sleeve 1220, an interfacing ring gear lug 1230 for transferring load from ring gear 1200 to rotary sleeve 1220, a lock key 1240, a lock key lug 1250, and a generally cylindrical anchor lock sleeve 1260 with an internal splined section 1261 and a seal groove 1262.

Rotary drive sleeve 1220 has a seal groove 1221 and an external driving thread 1222 which is close-fitting with and coaxially mounted to the exterior of housing 1110, reacting against lock sleeve 1260 to prevent axial translation. A generally cylindrical stroking drive sleeve 1270 with seal grooves 1271 and 1272, an internal thread 1273, and a lug hole 1274 threadingly engages with rotary drive sleeve 1220 (as described later herein).

Piston 1140 has an upper end 1141, a lower end 1142, and a middle radially-extended stepped section 1143 with threaded lug holes 1144 and a top lug hole 1145. In order to axially move the sliding sleeve 1161, pinion gear 1180 is rotated (such as by a socket wrench or other suitable torque application means), causing the gear teeth of pinion gear 1180 to engage ring gear teeth 1201 to rotate ring gear 1200 about the longitudinal axis of housing 1110, thus rotating rotary drive sleeve 1220 by load transfer through ring gear lugs 1230. This causes stroking drive sleeve 1270 to stroke axially along the exterior of housing 1110 as the rotation of rotary drive sleeve 1220 is converted to axial movement or stroke due to the threaded engagement of rotary drive sleeve 1220 and stroking drive sleeve 1270.

As best seen in FIG. 1A, the illustrated embodiment includes linkage means to facilitate operational engagement between the external stroking components and the internal sliding sleeve assembly, with the linkage means being provided in the form of pins 1280 passing through radial openings 1274 in the wall of stroking drive sleeve 1270, through piston actuation slots 1116 in housing 1110, and into mating lug holes 1144 in piston 1140. Pins 1280 carry circumferential seal grooves 1281 for sealing openings 1274 passing through housing slots 1116 and threading into piston hole 1144.

Piston actuation slots 1116 provide a reaction face against rotation for linkage 1280 and stroking drive sleeve 1270. Accordingly, piston 1140 strokes axially along with stroking drive sleeve 1270 and is further locked with the previously-described sliding sleeve assembly by lugs threaded into holes 1145 and extending into sliding sleeve holes 1162. To avoid premature actuation of this stroking mechanism, lock key 1240 is mounted to the radially exterior face of anchor lock sleeve 1260 and arranged such that it is locked in place between teeth 1201 and secured with lock key lug 1250, thereby preventing rotation of ring gear 1200 and rotary drive sleeve 1220.

Anchor lock sleeve 1260 has an internal splined section 1261 engageable with splines 1106 on top cap 1100 and external splined section 1119 on housing 1110, and thus is capable of transferring torque from top cap 1100 and housing 1110. Anchor lock sleeve 1260 has a lower external face mating onto the upper end of rotary drive sleeve 1220, and stroking drive sleeve 1270 seals against the outer diameter of housing 1110. Circumferential seal grooves 1262, 1221, and 1271 and 1272 are provided in anchor lock sleeve 1260, rotary sleeve 1220, and stroking drive sleeve 1270, respectively.

When plug-launching tool 100 has been fully assembled and rigged into a top-drive-suspended casing string, fluids such as drilling fluid and cement slurry can be pumped through plug-launching tool 100. When tool 100 is in the closed position as shown in FIG. 1, the fluid flow path, in sequence, will be:

- into tool 100 through internal cylindrical space 1320 through top cap 1100;
- into upper end 1330 of cage 1130, and down the cage until the flow path is blocked by the loaded wiper plug;
- out of cage 1130 through upper cage ports 1134 and into annular space 1300 between cage 1130 and housing 1110;
- downward within annular space 1300 until the flow path is blocked by bottom cap 1120;
- into cage 1130 through lower cage ports 1135; and
- downward through bottom cap 1120 and out of tool 100.

After tool 100 has been moved into its open position as shown in FIG. 2, upper ports 1134 are closed off as sliding sleeve 1161 and collet ramps 1165 are stroked axially down housing 1110 along with radially-expanded collet arms 1164. Extended collet jaws 1163 extend radially such that they no longer block the receiver bore, thereby allowing passage of the plug axially downward within cage 1130. With tool 100 now in this configuration, the fluid flow path, in sequence, will be:

- into tool 100 through cylindrical space 1320 in top cap 1100;
- into upper end 1330 of cage section 1132 and then downward within the cage until the fluid reaches the top of the wiper plug 1170, pushing the wiper plug down through receiver bore of cage section 1133; and
- continuing down the receiver bore section until it reaches section 1340 in the bottom cap 1120, at which point the wiper plug exits tool 100.

Plug-Launching Tool—Stacked Embodiments

Figure 4:
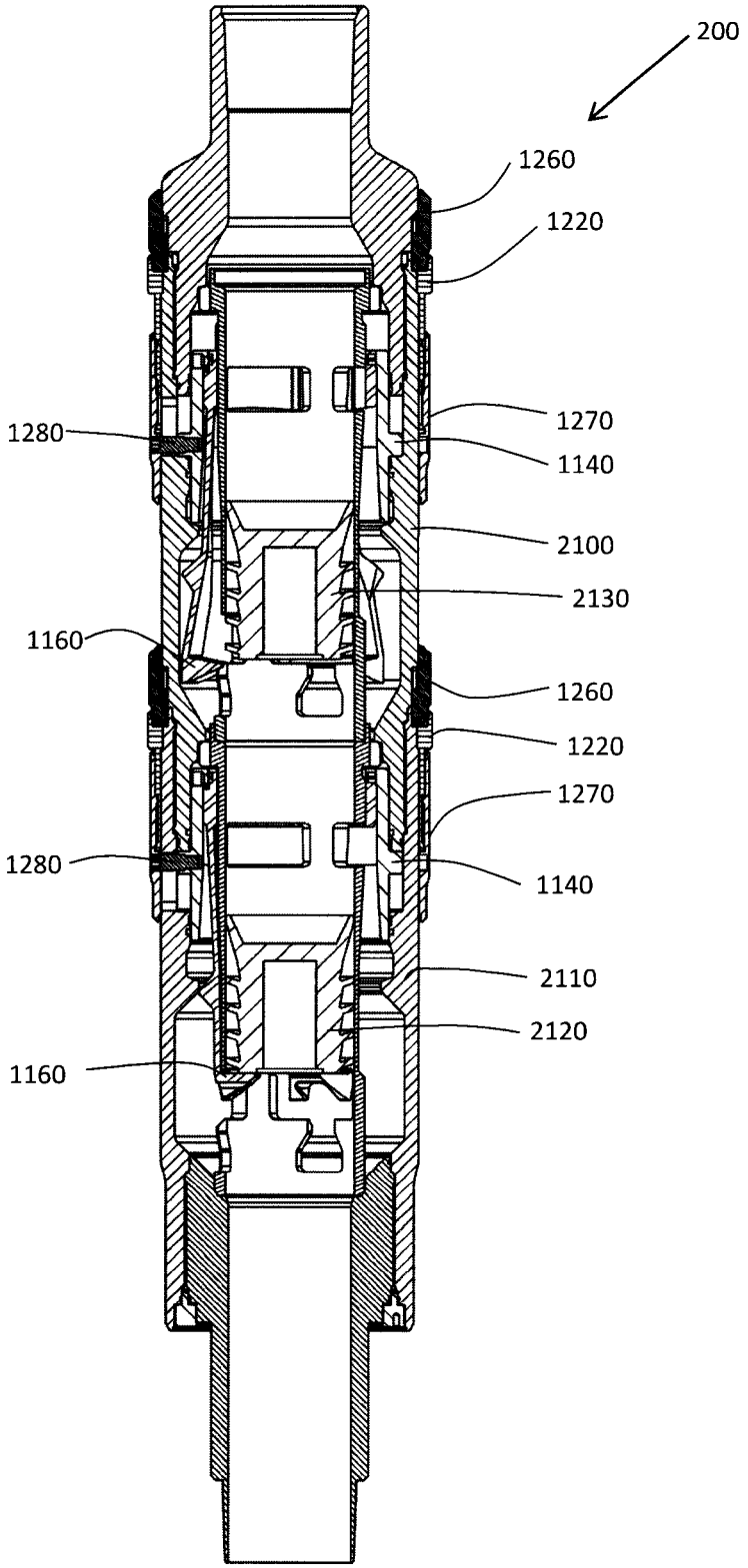
FIG. 4 is a longitudinal cross-section through an alternative embodiment of a plug-launching tool in accordance with the present disclosure, having a stacked, multiple-wiper plug configuration. The lower stack is shown in the retracted position, and the upper stack is shown in the extended position.

There is often a need in cementing operations to launch multiple plugs down the casing string. FIG. 4 illustrates an alternative embodiment 200 of a plug-launching tool in accordance with the present disclosure, with multiple plug stages to facilitate the launching of multiple plugs. In this embodiment, the sliding sleeve assembly, the collet assembly, and the means for releasing individual plugs are generally the same as in previously-described embodiments (i.e., per plug-launching tool 100), but these components are provided in numbers corresponding to the number of plugs to be launched.

Plug-launching tool 200 shown in FIG. 4 includes anchor lock sleeve 1260, external rotating ring 1220, external stroking drive sleeve 1270, interfacing pin 1280, piston 1140, and collet 1160, all generally as in embodiments that carry only one plug. However, the housing assembly is modified to include two independent housing stages (i.e., upper housing component stage 2100 and lower housing stage 2110), which lengthen the assembly to accommodate multiple plugs and activating actuation components inside tool 200. Upper housing stage 2100 retains an upper plug 2130, and lower housing stage 2110 retains a lower plug 2120. In order for these plugs to be launched in the proper sequence, bottom plug 2120 must be launched before top plug 2130.

This "stacked" embodiment's ability to launch multiple plugs is not limited to two plugs. Theoretically, there is no limit to the number of plugs that can be accommodated by modifying tool 200 to include an additional housing stage for each additional plug, with each housing stage stage having its own set of actuation components (1140, 1160, 1270, 1220, 1260, 1280) and its own receiver cage 1130.

Plug-Launching Tool—Additional Actuation Embodiments

Disclosed embodiments of the plug-launching tool may be readily adapted for pneumatic or hydraulic actuation (or other actuation means) by modifying the disclosed housing and piston assemblies in accordance with technology and methods within the knowledge and capabilities of persons skilled in the art, such that pneumatic or hydraulic components can be used to apply the stroking forces necessary to move the sliding sleeve between the closed and open positions and thus to launch the plug.

Figure 5:
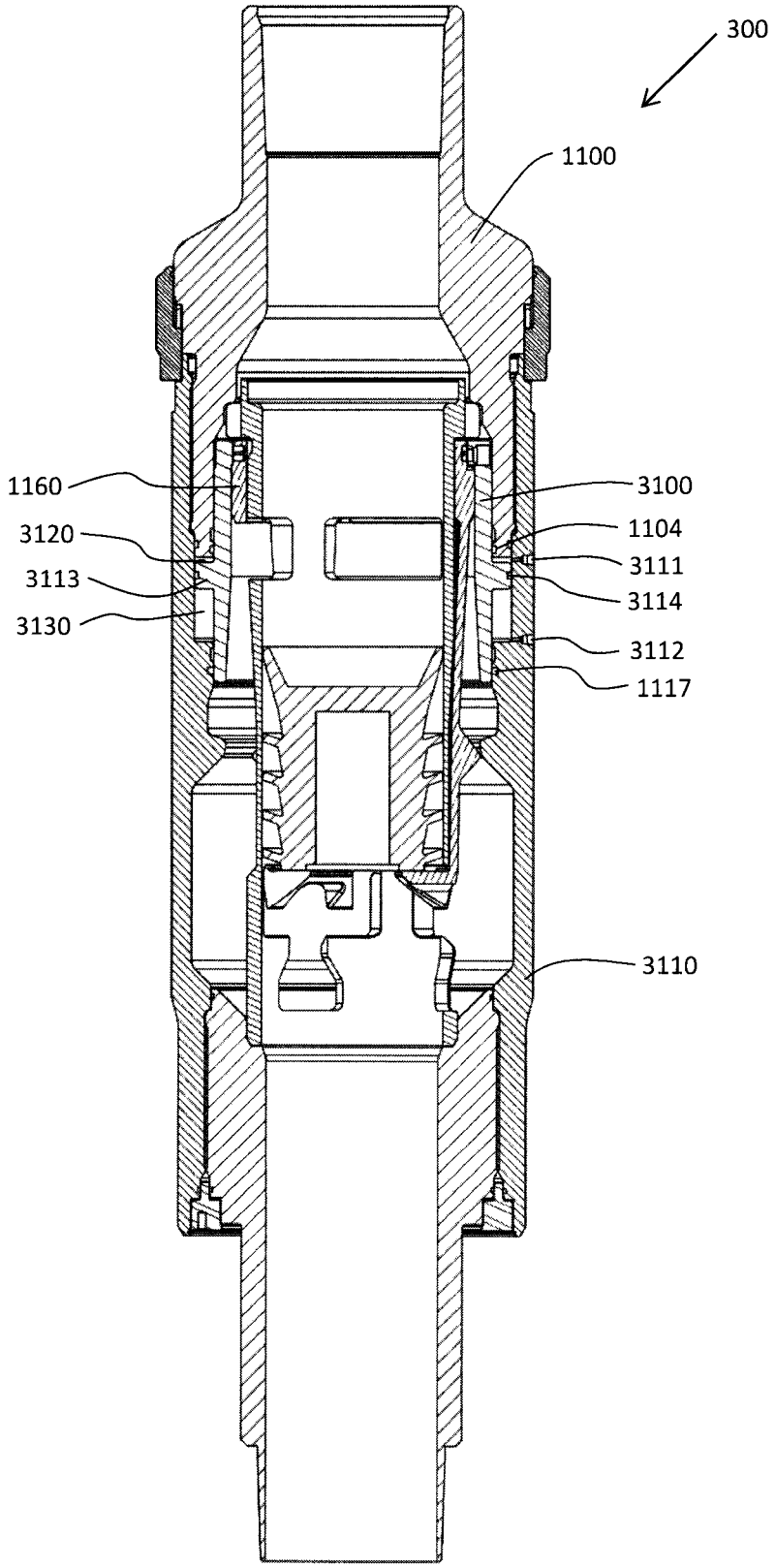
FIG. 5 is a longitudinal cross-section through a further alternative embodiment of a plug-launching tool in accordance with the present disclosure, with pneumatic actuation.

By way of non-limiting example, FIG. 5 illustrates a further alternative embodiment 300 of a plug-launching tool in accordance with the present disclosure that uses a pneumatic system for stroking a modified piston 3100 and collet 1160 down a modified housing 3110. Housing 3110 has upper and lower pressure ports 3111 and 3112 extending through the wall of housing 3110 on upper and lower sides of a piston extension 3113, with appropriate pressure fittings mounted in ports 3111 and 3112. Piston 3100 does not have interfacing pin holes as in the embodiment shown in FIG. 1, but has a sealing groove 3114 (with appropriate sealing element) on the terminal circumferential face of piston extension 3113. This seal creates an upper chamber 3120 and a lower chamber 3130 on the upper and lower sides of piston extension 3113. Pressure can be applied into and bled out of chambers 3120 and 3130 through pressure ports 3111 and 3112. The axial stroke of piston 3100 is initiated by pressurizing upper chamber 3120 with compressed air (or other suitable pressurized gas), provided that the force provided to stroke the internal components axially down the housing is sufficiently large to break the friction in the seals in seal grooves 3114, 1104, and 1117. As previously described, the axial stroking of piston 3100 and collet 1160 will cause the plug to be released from plug-launching tool 300. Pressure may then be bled from upper chamber 3120, followed by pressurization of lower chamber 3130 through pressure port 3112, thus generating the axial force necessary to stroke piston 3100 back up housing 3110, and thereby returning tool 300 to its closed position.

It will be readily appreciated by those skilled in the art that various modifications to embodiments in accordance with the present disclosure may be devised without departing from the scope of the present teachings, including modifications which may use equivalent structures or materials hereafter conceived or developed. It is to be especially understood that the scope of the present disclosure is not intended to be limited to described or illustrated embodiments, and that the substitution of a variant of a claimed or illustrated element or feature, without any substantial resultant change in functionality, will not constitute a departure from the scope of the disclosure.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational and conformational terms such as "perpendicular", "coaxial", and "cylindrical" are not intended to denote or require absolute mathematical or geometrical precision. Accordingly, such terms are to be understood as denoting or requiring substantial precision only (e.g., "substantially perpendicular") unless the context clearly requires otherwise. Wherever used in this document, the terms "typical" and "typically" are to be interpreted in the sense of representative of common usage or practice, and are not to be understood as implying essentiality or invariability.

The embodiments in which an exclusive property or privilege is claimed are defined as follows:

1. A plug-launching tool comprising:

(a) a generally axisymmetric housing having a housing bore;

(b) a sliding sleeve coaxially movable within the housing bore between a closed position and an open position, said sliding sleeve having a cylindrical outer surface sealingly engageable with a cylindrical interval of the housing bore;

(c) actuation means, for axially moving the sliding sleeve between a closed position and an open position;

(d) a plug receiver bore carried by either the housing or the sliding sleeve, wherein the plug receiver bore:

(d.1) is in upstream fluid communication with the housing bore;

(d.2) includes a retained plug interval for receiving and releasably retaining a selected plug; and (d.3) is sized to allow passage of the plug downstream of the retained plug interval;

(e) a collet assembly coaxially disposed within the housing bore and carried by either the sliding sleeve or the housing, wherein:

(e.1) the collet assembly includes a collet body having a generally cylindrical bore configured to accommodate passage of the plug; and (e.2) the collet body carries one or more collet jaws linked to the collet body so as to be movable between a radially-inward closed position and a radially-outward open position, wherein the collet jaws, in their closed position, at least partially occlude the receiver bore, so as to retain the plug within the retained plug interval; and (f) linkage means, for linking axial movement of the sliding sleeve to radial movement of the collet jaws, such that the collet jaws will be urged toward their closed and open positions when the sliding sleeve is moved toward its closed and open positions, respectively.

2. A plug-launching tool as in claim 1 wherein:

(a) the sliding sleeve incorporates a piston operatively linked to the sliding sleeve to facilitate movement of the sliding sleeve between its closed and open positions;

(b) the housing has one or more piston-actuation openings extending through the wall of the housing; and (c) the piston defines the cylindrical outer surface of the sliding sleeve, with said cylindrical outer surface being sealingly engageable with the cylindrical interval of the housing bore above and below the one or more piston-actuation openings so as to close off the one or more piston-actuation openings.

3. A plug-launching tool as in claim 2 wherein the actuation means actuates the sliding sleeve by rotary actuation about a longitudinal axis of the housing.

4. A plug-launching tool as in claim 3, further comprising a rotary drive sleeve coaxially mounted to and close-fitting with the housing exterior, wherein:

(a) the rotary drive sleeve allows rotation about the housing axis while reacting against axial translation along the housing; and (b) the rotary drive sleeve threadingly engages a stroking drive sleeve that is close-fitting with and slidably mounted to the housing, while being connected to the piston via the piston-actuation openings so as to prevent rotation about the housing axis, such that it will stroke the sliding sleeve upon rotation of the rotary drive sleeve.

5. A plug-launching tool as in claim 2 wherein the actuation means actuates the sliding sleeve by rotary actuation about a radial axis generally normal to the housing surface.

6. A plug-launching tool as in claim 5, further comprising a rotary drive sleeve coaxially mounted to and close-fitting with the housing exterior, wherein the rotary actuation is provided by means of a drive gear rotating on a radially-oriented axle externally mounted to the sliding sleeve, with the drive gear being arranged to mesh with ring gear teeth provided on the rotary drive sleeve.

7. A plug-launching tool as claim 2 wherein the actuation means actuates the sliding sleeve by rotary actuation about a generally tangent axis.

8. A plug-launching tool as in claim 7, further comprising a rotary drive sleeve coaxially mounted to and close-fitting with the housing exterior, wherein the rotary actuation is provided by means of a drive gear rotating on a radially-oriented axle externally mounted to the sliding sleeve, with the drive gear being arranged to mesh with ring gear teeth provided on the rotary drive sleeve.

9. A plug-launching tool as in claim 2 wherein the piston is carried by the housing, and wherein the rotary actuation is provided by means of a worm gear tangentially mounted to the housing surface and engaging gear teeth provided on the rotary drive sleeve.

10. A plug-launching tool as in claim 2 wherein actuation of the sliding sleeve is provided by means of a double-acting hydraulic or pneumatic actuator, with the housing being configured to act as a cylinder body, and having external ports for entry of a pressurized actuating fluid, with either rigid or swiveling fluid line connections to the fluid entry ports as appropriate for particular operational requirements.

11. A plug-launching tool as in claim 1 wherein the collet arms bias the collet jaws toward the radially-open position.

12. A plug-launching tool as in claim 11 wherein the collet jaws are biased toward the radially-open position by the collet arms being elastically resilient.

13. A plug-launching tool as in claim 1 wherein the one or more collet jaws are provided with upstream-facing land surfaces collectively providing a land for the plug when the collet jaws are in the closed position.

14. A plug-launching tool comprising:

(a) a generally axisymmetric housing having a housing bore;

(b) a generally cylindrical receiver cage having a main body with upper and lower ends and defining a plug receiver bore, wherein:

(b.1) the receiver cage is coaxially disposed within the housing;

(b.2) the housing bore is configured to support the receiver cage at the upper end and/or at the lower end thereof, and defines a housing bore annulus between the housing and the receiver cage's main body;

(b.3) the housing bore extends through housing and the receiver cage, and is configured to allow downstream passage of a selected plug; and (b.4) upper and lower sets of receiver cage ports extend through a wall of the receiver cage's main body, defining an unported receiver cage interval between the upper receiver cage ports and the lower receiver cage ports, and defining a retained plug interval in a middle region of the receiver cage's main body, with the length of the retained plug interval being at least approximately equal to the length of the selected plug;

(c) a sliding sleeve coaxially and slidably disposed within the housing bore annulus in a region generally corresponding to the upper ports in the receiver cage, wherein the sliding sleeve is movable between:

(c.1) a closed position in which the upper receiver cage ports are uncovered so as to allow fluid flow into the housing bore annulus through the upper receiver cage ports; and (c.2) an open position in which the upper receiver cage ports are at least partially blocked so as to restrict fluid flow into the housing bore annulus, such that at least part of the fluid flow will be diverted through the retained plug interval;

(d) actuation means, for axially moving the sliding sleeve between a closed position and an open position;

(e) a fluid flow path by-passing the retained plug interval, to allow downstream fluid flow within the housing annulus to the lower receiver cage ports; and (f) a collet assembly comprising a plurality of collet jaws linked to the sliding sleeve by collet arms extending axially downward from the sliding sleeve, wherein:

(f.1) the collet assembly is configured to axially position each collet jaw in an associated lower receiver cage lower port such that the collet jaws will extend radially inward into the plug receiver bore;

(f.2) the collet arms are engageable with the housing bore through a first cam interface to urge the collet jaws toward their closed position when the sliding sleeve is moved toward its closed position; and (f.3) the collet jaws are engageable with the receiver cage through a second cam interface between the jaw segments and surfaces of the receiver cage ports in which they move, so as to urge the collet jaws toward the open position when the sliding sleeve is moved toward its open position.

15. A plug-launching tool as in claim 14 wherein the housing is configured to accommodate one or more auxiliary receiver cages disposed coaxially with the receiver cage recited in claim 2, with each auxiliary receiver cage being provided with an associated auxiliary sliding sleeve, an associated auxiliary collet assembly, and associated auxiliary actuation means.

16. A plug-launching tool as in claim 14 wherein:

(a) the tool further comprises a piston operatively linked to the sliding sleeve to facilitate movement of the sliding sleeve between its closed and open positions; and (b) the housing has one or more piston-actuation openings extending through the wall of the housing;

wherein the piston is sealingly engageable with the housing bore so as to close off the piston-actuation openings.

17. A plug-launching tool as in claim 16 wherein the actuation means actuates the sliding sleeve by rotary actuation about a longitudinal axis of the housing.

18. A plug-launching tool as in claim 17, further comprising a rotary drive sleeve coaxially mounted to and close-fitting with the housing exterior, wherein:

(a) the rotary drive sleeve allows rotation about the housing axis while reacting against axial translation along the housing; and (b) the rotary drive sleeve threadingly engages a stroking drive sleeve that is close-fitting with and slidably mounted to the housing, while being connected to the sliding sleeve piston via the piston-actuation openings so as to prevent rotation about the housing axis, such that it will stroke the sliding sleeve upon rotation of the rotary drive sleeve.

19. A plug-launching tool as in claim 16 wherein the actuation means actuates the sliding sleeve by rotary actuation about a radial axis generally normal to the housing surface.

20. A plug-launching tool as in claim 19, further comprising a rotary drive sleeve coaxially mounted to and close-fitting with the housing exterior, wherein the rotary actuation is provided by means of a drive gear rotating on a radially-oriented axle externally mounted to the sliding sleeve, with the drive gear being arranged to mesh with ring gear teeth provided on the rotary drive sleeve.

21. A plug-launching tool as claim 16 wherein the actuation means actuates the sliding sleeve by rotary actuation about a generally tangent axis.

22. A plug-launching tool as in claim 21, further comprising a rotary drive sleeve coaxially mounted to and close-fitting with the housing exterior, wherein the rotary actuation is provided by means of a drive gear rotating on a radially-oriented axle externally mounted to the sliding sleeve, with the drive gear being arranged to mesh with ring gear teeth provided on the rotary drive sleeve.

23. A plug-launching tool as in claim 16 wherein the piston is carried by the housing, and wherein the rotary actuation is provided by means of a worm gear tangentially mounted to the housing surface and engaging gear teeth provided on the rotary drive sleeve.

24. A plug-launching tool as in claim 16 wherein actuation of the sliding sleeve is provided by means of a double-acting hydraulic or pneumatic actuator, with the housing being configured to act as a cylinder body, and having external ports for entry of a pressurized actuating fluid, with either rigid or swiveling fluid line connections to the fluid entry ports as appropriate for particular operational requirements.

* * * * *